US006455485B1

(12) United States Patent
Coosemans et al.

(10) Patent No.: US 6,455,485 B1
(45) **Date of Patent: *Sep. 24, 2002**

(54) NONAQUEOUS LIQUID DETERGENT COMPOSITIONS CONTAINING BLEACH PRECURSORS

(75) Inventors: Steven Jozef Louis Coosemans, Kampenhout; Axel Meyer, Brussels; Jean-Pol Boutique, Gembloux; James Pyott Johnston, Overijse, all of (BE)

(73) Assignee: The Procter & Gamble Company, Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/202,875

(22) PCT Filed: Jun. 24, 1997

(86) PCT No.: PCT/US97/10116

§ 371 (c)(1),
(2), (4) Date: Dec. 22, 1998

(87) PCT Pub. No.: WO98/00510

PCT Pub. Date: Jan. 8, 1998

Related U.S. Application Data

(60) Provisional application No. 60/020,827, filed on Jun. 28, 1996.

(51) Int. Cl.[7] ..... C11D 3/395; C11D 7/18; C11D 7/54

(52) U.S. Cl. ..... 510/304; 510/313; 510/310; 510/318; 510/338; 510/342; 510/371; 510/407

(58) Field of Search ..... 510/304, 313, 510/310, 318, 338, 342, 371, 407

(56) References Cited

U.S. PATENT DOCUMENTS

| | | | | | |
|---|---|---|---|---|---|
| 4,615,819 | A | | 10/1986 | Leng et al. | |
| 4,619,779 | A | * | 10/1986 | Hardy | 510/513 |
| 4,772,413 | A | | 9/1988 | Massaux et al. | 252/102 |
| 4,981,606 | A | * | 1/1991 | Barnes | 510/371 |
| 4,988,451 | A | * | 1/1991 | Nunn et al. | 510/312 |
| 5,102,574 | A | * | 4/1992 | Russell et al. | 510/413 |
| 5,409,621 | A | | 4/1995 | Ellis et al. | |
| 5,429,773 | A | | 7/1995 | Sherry et al. | |
| 5,561,235 | A | * | 10/1996 | Gosselink | 546/210 |
| 5,591,378 | A | * | 1/1997 | Deline et al. | 252/186.38 |
| 5,686,015 | A | * | 11/1997 | Willey et al. | 252/186.39 |
| 5,817,614 | A | * | 10/1998 | Miracle et al. | 510/376 |
| 5,955,416 | A | * | 9/1999 | Baillely et al. | 510/357 |

FOREIGN PATENT DOCUMENTS

| | | | |
|---|---|---|---|
| EP | 0 170 386 | 5/1986 | C11D/3/39 |
| EP | 325 184 A1 | 7/1989 | C11D/1/66 |
| EP | 0 333 248 | 9/1989 | C11D/3/39 |
| EP | 0 337 274 A2 | 10/1989 | C11D/3/39 |
| EP | 0 540 090 A2 | 5/1993 | C11D/17/00 |
| EP | 0 738 778 A1 | 10/1996 | C11D/17/00 |

* cited by examiner

*Primary Examiner*—Cynthia H. Kelly
*Assistant Examiner*—Dawn Garrett
(74) *Attorney, Agent, or Firm*—Armina E. Matthews; Kim William Zerby; Steven W. Miller

(57) ABSTRACT

There is provided a liquid nonaqueous detergent composition comprising an alcohol alkoxylate nonionic surfactant and a bleach precursor having a Krafft point of at least 10° C., said surfactant and said precursor being present in a molar ratio of nonionic surfactant to bleach precursor of at least 2:1.

25 Claims, No Drawings

NONAQUEOUS LIQUID DETERGENT COMPOSITIONS CONTAINING BLEACH PRECURSORS

This application is a 371 of PCT/US97/10116 filed Jun. 24, 1997, which claims benefit of Provisional No. 60/020, 827 filed Jun. 28, 1996.

FIELD OF THE INVENTION

This invention relates to liquid laundry detergent products which are nonaqueous in nature and which contain peroxyacid bleach precursors having an effective dissolution rate.

BACKGROUND OF THE INVENTION

Liquid nonaqueous detergents are well known in the art. This class of detergents is particularly interesting for enhancing the chemical compatibility of detergent composition components, in particular bleach precursors and bleach sources.

In such nonaqueous products, these bleaching precursors are less reactive than if they had been dissolved in the aqueous liquid matrix.

A preferred class of bleach precursors are those having a Krafft point of at least 10° C. Said bleach precursors are reputed to be very effective in stain removal, cleaning and whitening. Examples of said bleach precursors are amide substituted peroxyacid precursor compounds such as (6-octanamido-caproyl) oxy benzene sulfonate, (6-nonanamidocaproyl)oxy benzene sulfonate and (6-decanamidocaproyl)oxy benzene sulfonate as described in EP-A-0 170 386.

A drawback of said bleach precursors is their low dissolution rate. As a result, the perhydrolysis rate is reduced which in turn affects the cleaning performance. This problem is even more acute with the move in consumer washing habits towards lower temperature and shorter wash cycle. Problems can also, in particular, be encountered when the said bleach precursors are used under high hardness conditions, resulting upon dissolution in the formation of calcium salts of low solubility. Such a problem of reduced perhydrolysis is further increased where the bleach precursor is present in a form that exhibits a very low rate of dissolution, thus affecting the perhydrolysis rate.

A further problem, associated with the bleach precursors having slow perhydrolysis rates, appears when the soiled fabrics release the enzyme catalase. Hence, due to the slow perhydrolysis of the precursor, the catalase will destroy the hydrogen peroxide component before the bleach activator is properly perhydrolysed. As a result, the concentration of peracid present in the wash is reduced and so is the bleaching performance.

Accordingly, the formulator of a nonaqueous liquid detergent composition is faced with the challenge of formulating a nonaqueous liquid detergent composition which provides effective dissolution of the precursor in order to result in an efficient perhydrolysis.

The Applicant has now found that the use of high levels of alcohol alkoxylate nonionic surfactants relative to the levels of bleach precursors having a Krafft point of at least 10° C., within a liquid nonaqueous detergent composition or within the aqueous wash liquor, fulfills such a need.

It is therefore an advantage of the invention to provide bleach precursors containing-detergent compositions which produce efficient rate of dissolution.

It is another advantage of the invention to provide compositions which enable the use of divalent or trivalent salts.

It is a further advantage of the invention to provide compositions with improved resistance to enzyme catalase.

It is another advantage of the invention to provide compositions which enable the use of a lower amount of peroxygen bleach.

Nonaqueous liquid detergent compositions containing bleach precursors are described in EP 540 090. This document does not disclose or suggest that using alcohol ethoxylated surfactants increases the rate of dissolution/perhydrolysis of bleach precursors.

SUMMARY OF THE INVENTION

The present invention relates to a liquid nonaqueous detergent composition comprising an alcohol alkoxylate nonionic surfactant and a bleach precursor having a Krafft point of at least 10° C., said surfactant and said precursor being present in a molar ratio of nonionic surfactant to bleach precursor of at least 2:1.

DETAILED DESCRIPTION OF THE INVENTION

Alcohol Alkoxylated Nonionic Surfactant

An essential component of the invention is an alcohol alkoxylate nonionic surfactant. Such type of surfactant is believed to help to dissolve the hydrophobic bleach activator by forming mixed micelles, which also prevent to some extent the precipitation of the bleach activator in presence of hardness. Without wishing to be bound by theory, it is also believed that comicellisation could also speed up perhydrolysis by making the precursor molecule more accessible to the hydrogen peroxide.

Said nonionic surfactant is typically present in a level form 5 to 50%, preferably 10 to 30%, most preferred from 15 to 25 % by weight of the total detergent composition.

Suitable alcohol alkoxylate nonionic surfactant class of compounds which may be broadly defined as compounds produced by the condensation of alkylene oxide groups (hydrophilic in nature) with an organic hydrophobic compound, which may be branched or linear aliphatic (e.g. Guerbet or secondary alcohols) or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements.

Suitable exemplary classes of such alcohol alkoxylate nonionic surfactant are listed below:

1. The polyethylene, polypropylene, and polybutylene oxide condensates of alkyl phenols. In general, the polyethylene oxide condensates are preferred. These compounds include the condensation products of alkyl phenols having an alkyl group containing from 6 to 12 carbon atoms in either a straight- or branched-chain configuration with the alkylene oxide. In a preferred embodiment, the ethylene oxide is present in an amount equal to from 5 to 25 moles of ethylene oxide per mole of alkyl phenol. Commercially available nonionic surfactants of this type include Igepal™ CO-630, marketed by the GAF Corporation; and Triton™ X-45, X-114, X-100, and X-102, all marketed by the Rohm & Haas Company.
2. The condensation products of aliphatic alcohols with from 1 to 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from 10 to 20 carbon atoms with from 2 to 10 moles of ethylene oxide per mole of alcohol. Examples of commercially available nonionic surfactants of this type include Tergitol™ 15-S-9 (the condensation product of $C_{11}$–$C_{15}$ linear alcohol with 9 moles ethylene oxide), Tergitol™ 24-L-6 NMW (the condensation product of $C_{12}$–$C_{14}$ primary alcohol with 6 moles ethylene oxide with a narrow molecular weight distribution), both marketed by Union Carbide Corporation; Neodol™ 45-9 (the condensation product of $C_{14}$–$C_{15}$ linear alcohol with 9 moles of ethylene oxide), Neodol™ 23-6.5 (the condensation product of $C_{12}$–$C_{13}$ linear alcohol with 6.5 moles of ethylene oxide), Neodol™ 45-7 (the condensation product of $C_{14}$–$C_{15}$ linear alcohol with 7 moles of ethylene oxide), Neodol™ 45-4 (the condensation product of $C_{14}$–$C_{15}$ linear alcohol with 4 moles of ethylene oxide), marketed by Shell Chemical Company, and Kyro™ EOB (the condensation product of $C_{13}$–$C_{15}$ alcohol with 9 moles ethylene oxide), marketed by The Procter & Gamble Company.

3. The condensation products of ethylene oxide with a hydrophobic base formed by the condensation of propylene oxide with propylene glycol. The hydrophobic portion of these compounds preferably has a molecular weight of from 1500 to 1800 and exhibits water insolubility. The addition of polyoxyethylene moieties to this hydrophobic portion tends to increase the water solubility of the molecule as a whole, and the liquid character of the product is retained up to the point where the polyoxyethylene content is 50% of the total weight of the condensation product, which corresponds to condensation with up to 40 moles of ethylene oxide. Examples of compounds of this type include certain of the commercially-available Pluronic™ surfactants, marketed by BASF.
4. The condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from 2500 to 3000. This hydrophobic moiety is condensed with ethylene oxide to the extent that the condensation product contains from 40% to 80% by weight of polyoxyethylene and has a molecular weight of from 5,000 to 11,000. Examples of this type of nonionic surfactant include certain of the commercially available Tetronic™ compounds, marketed by BASF.

Mixtures of any of the above mentioned nonionic alkoxylated surfactants may be used.

The nonionic surfactant may be included within the detergent composition of the invention by any means so long as the molar ratio requirement within the composition, as defined herein after, is fullfilled or the level of nonionic within the wash liquor, as defined herein after, is present. It may be processed together with the bleach precursor having a Krafft point of at least 10° C. so as to form an agglomerate. It may also be included as a separate component from the bleach into the detergent composition. Mixture of any of these processes can be used.

Bleach Precursor Having a Krafft Point of at Least 10° C.

The other essential component of the invention is a bleach precursor having a Krafft point of at least 10° C., preferably at least 50° C., more preferably of at least 60° C. By Krafft point is meant the temperature above which a solution of 10% by weight of the bleach activator in deionised water becomes perfectly clear transparent. By "clear transparent" is meant a substance which permits the passage of rays of the visible spectrum. The bleach precursors suitable for use are preferably of the anionic type.

Suitable anionic bleach precursors for the purpose of the invention comprise compounds with at least one acyl group forming the peroxyacid moiety bonded to a leaving group through an —O— or —N— linkage.

Suitable anionic peroxyacid bleach precursors for the purpose of the invention are the amide substituted compounds of the following general formulae:

R1N(R5)C(O)R2C(O)L or R1C(O)N(R5)R2C(O)L wherein R1 is an alkyl, aryl or alkaryl group with from 1 to 14 carbon atoms, R2 is an alkylene, arylene, and alkarylene group containing from 1 to 14 carbon atoms, and R5 is H or an alkyl, aryl, or alkaryl group containing 1 to 10 carbon atoms and L can be essentially any leaving group. R1 preferably contains from 6 to 12 carbon atoms. R2 preferably contains from 4 to 8 carbon atoms. R1 may be straight chain or branched alkyl, substituted aryl or alkylaryl containing branching, substitution, or both and may be sourced from either synthetic sources or natural sources including for example, tallow fat. Analogous structural variations are permissible for R2. R2 can include alkyl, aryl, wherein said R2 may also contain halogen, nitrogen, sulphur and other typical substituent groups or organic compounds. R5 is preferably H or methyl. R1 and R5 should not contain more than 18 carbon atoms total. Amide substituted bleach activator compounds of this type are described in EP-A-0170386.

The leaving group, hereinafter L group, must be sufficiently reactive for the perhydrolysis reaction to occur within the optimum time frame (e.g., a wash cycle). However, if L is too reactive, this activator will be difficult to stabilize for use in a detergent composition.

Preferred L groups are selected from:

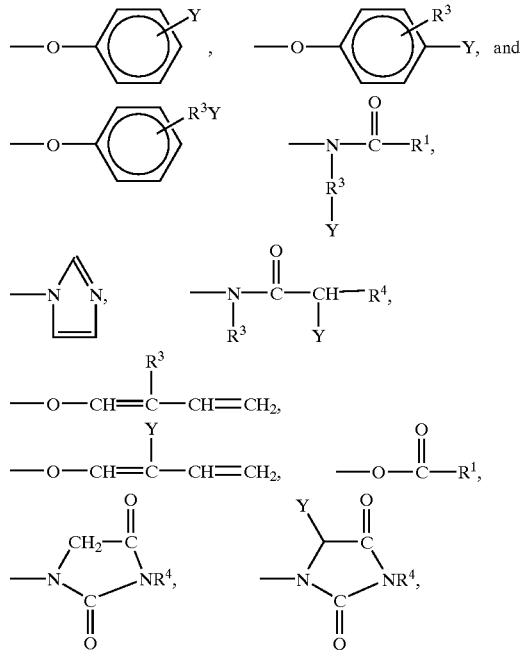

-continued

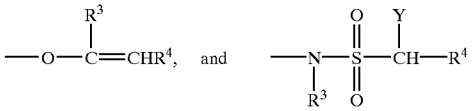

and mixtures thereof, wherein R1 is an alkyl, aryl, or alkaryl group containing from 1 to 14 carbon atoms, R3 is an alkyl chain containing from 1 to 8 carbon atoms, R4 is H or R3, and Y is H or a solubilizing group. Any of R1, R3 and R4 may be substituted by essentially any functional group including, for example alkyl, hydroxy, alkoxy, halogen, amine, nitrosyl, amide and ammonium or alkyl ammmonium groups.

The preferred solubilizing groups are —SO3—M+, —CO2—M+, —SO4—M+, —N+(R3)4X— and O←—N (R3)3 and most preferably —SO3—M+ and —CO2—M+ wherein R3 is an alkyl chain containing from 1 to 4 carbon atoms, M is a cation and X is an anion. Preferably, M is an alkali metal, ammonium or substituted ammonium cation, with sodium and potassium being most preferred, and X is a halide, hydroxide, methylsulfate or acetate anion.

Preferred examples of bleach precursors of the above formulae include amide substituted peroxyacid precursor compounds selected from (6-octanamido-caproyl) oxybenzenesulfonate, (6-nonanamidocaproyl)oxy benzene sulfonate, (6-decanamido-caproyl)oxybenzenesulfonate, and mixtures thereof as described in EP-A-0170386.

The Applicant also found that further anionic bleach precursor having a Krafft point of at least 10° C. could be used in place or in combination of the above mentioned anionic bleach precursors. Such precursors are the above mentioned anionic bleach precursor present as a monovalent, divalent and/or trivalent metal salt. This finding is especially surprising as such bleach precursor salts have a low solubility in water. Typical examples of such low solubility bleach precursors include Mg ((6-octanamido-caproyl)oxybenzenesulfonate)$_2$, Mg ((6-nonanamido caproyl)oxy benzenesulfonate)$_2$, Mg ((6-decanamido-caproyl)oxybenzene sulfonate)$_2$, Ca ((6-octanamido-caproyl)oxybenzenesulfonate)$_2$, Ca ((6-nonanamido-caproyl) oxy benzenesulfonate)$_2$, Ca ((6-decanamido-caproyl) oxy benzenesulfonate)$_2$, and mixtures thereof.

It is therefore an advantage of the invention to allow the use of anionic bleach precursors present as monovalent, divalent and/or trivalent metal salts.

Mixtures of any of the peroxyacid bleach precursor, herein before described, may also be used.

Preferred among the above mentioned peroxyacid bleach precursors are the amide substituted peroxyacid precursor compounds selected from (6-octanamido-caproyl) oxybenzenesulfonate, (6-nonanamidocaproyl)oxy benzene sulfonate, (6-decanamido-caproyl)oxybenzenesulfonate, and mixtures thereof.

Typical levels of the peroxyacid bleach precursors having a Krafft point of at least 10° C. within the detergent compositions are from 0.1% to 25%, preferably from 1% to 20% and most preferably 3 to 15% by weight of the composition.

It is also an essential requirement of the detergent composition of the invention that the nonionic surfactant and the precusor be present in a molar ratio of at least 2:1, preferably above 4:1.

With such a requirement, without wishing to be bound by theory, it is believed that the alcohol alkoxylate nonionic surfactant helps to dissolve the bleach precursors having a Krafft point of at least 10° C. by forming mixed micelles, which also prevent to some extent the precipitation of said bleach activator in presence of hardness.

Optional Co-precursors

Optional bleach precursors may be used in addition to the bleach precursor having a Krafft point of at least 10° C. so as to provide a detergent composition with a broader spectrum of soil removal. These bleach co-precursors have a Krafft point of less than 10° C. or are liquid bleach activators.

Suitable peroxyacid bleach co-precursors include the tetraacetyl ethylene diamine (TAED) bleach precursor.

Still another class of bleach precursor having a Krafft point of less than 10° C. is the class of alkyl percarboxylic acid bleach precursors. Preferred alkyl percarboxylic acid precursors include nonanoyl oxy benzene sulphonate (NOBS described in U.S. Pat. No. 4,412,934) and Na 3,5,5-tri-methyl hexanoyl oxybenzene sulfonate (ISONOBS described in EP120,591) and salts thereof.

Still another class of bleach precursors suitable as a co-precursor are the N-acylated precursor compounds of the lactam class disclosed generally in GB-A-955735. Preferred materials of this class comprise the caprolactams.

Suitable caprolactam bleach precursors are of the formula:

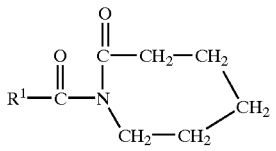

wherein $R^1$ is an alkyl, aryl, alkoxyaryl or alkaryl group containing from 6 to 12 carbon atoms. Preferred hydrophobic N-acyl caprolactam bleach precursor materials are selected from benzoyl caprolactam, octanoyl caprolactam, nonanoyl caprolactam, decanoyl caprolactam, undecenoyl caprolactam, 3,5,5-trimethylhexanoyl caprolactam and mixtures thereof. A most preferred is nonanoyl caprolactam.

Suitable valero lactams have the formula:

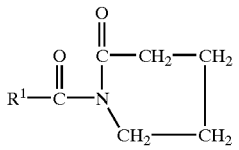

wherein $R^1$ is an alkyl, aryl, alkoxyaryl or alkaryl group containing from 6 to 12 carbon atoms. More preferably, $R^1$ is selected from phenyl, heptyl, octyl, nonyl, 2,4,4-trimethylpentyl, decenyl and mixtures thereof.

Highly preferred among these additional activators is the peroxyacid bleach precursor tetraacetyl ethylene diamine (TAED) bleach precursor.

Other suitable bleach precursors are the cationic bleach precursors. Suitable cationic peroxyacid precursors include any of the ammonium or alkyl ammonium substituted alkyl or benzoyl oxybenzene sulfonates, N-acylated caprolactams, N-acylated valerolactams and monobenzoyltetraacetyl glucose benzoyl peroxides. Preferred cationic bleach precursors are derived from the valerolactam and acyl caprolactam compounds, of formula:

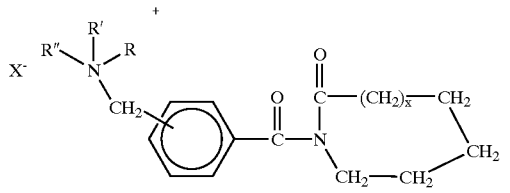

wherein x is 0 or 1, substituents R, R' and R" are each C1–C10 alkyl or C2–C4 hydroxy alkyl groups, or $[(C_yH_{2y})O]_n$—R'" wherein y=2–4, n=1–20 and R'" is a C1–C4 alkyl group or hydrogen and X is an anion.

When present, said co-precursors will normally be incorporated at a level of from 0.1% to 60%, preferably from 1% to 40% and most preferably 3 to 25% by weight of the detergent composition.

Preferably the detergent composition of the invention will comprise a hydrogen peroxide source.

Hydrogen Peroxide Sources

Preferred sources of hydrogen peroxide include perhydrate bleaches. The perhydrate is typically an inorganic perhydrate bleach, normally in the form of the sodium salt, as the source of alkaline hydrogen peroxide in the wash liquor. This perhydrate is normally incorporated at a level of from 0.1% to 60%, preferably from 3% to 40% by weight, more preferably from 5% to 35% by weight and most preferably from 8% to 30% by weight of the composition.

The perhydrate may be any of the alkalimetal inorganic salts such as perborate monchydrate or tetrahydrate, percarbonate, perphosphate and persilicate salts but is conventionally an alkali metal perborate or percarbonate.

Sodium percarbonate, which is the preferred perhydrate, is an addition compound having a formula corresponding to 2Na2CO3.3H202, and is available commercially as a crystalline solid. Most commercially available material includes a low level of a heavy metal sequestrant such as EDTA, 1-hydroxyethylidene 1, 1-diphosphonic acid (HEDP) or an amino-phosphonate, that is incorporated during the manufacturing process. For the purposes of the detergent composition aspect of the present invention, the percarbonate can be incorporated into detergent compositions without additional protection, but preferred executions of such compositions utilise a coated form of the material. A variety of coatings can be used including borate, boric acid and citrate or sodium silicate of SiO2:Na2O ratio from 1.6:1 to 3.4:1, preferably 2.8:1, applied as an aqueous solution to give a level of from 2% to 10%, (normally from 3% to 5%) of silicate solids by weight of the percarbonate. However the most preferred coating is a mixture of sodium carbonate and sulphate or sodium chloride.

The nonaqueous detergent compositions of this invention may further comprise a surfactant- and low-polarity solvent-containing liquid phase. The components of the liquid and solid phases of the detergent compositions herein, as well as composition form, preparation and use, are described in greater detail as follows:

All concentrations and ratios are on a weight basis unless otherwise specified.

Additional Surfactant

The amount of the surfactant mixture component of the detergent compositions herein can vary depending upon the nature and amount of other composition components and depending upon the desired rheological properties of the ultimately formed composition. Generally, this surfactant mixture will be used in an amount comprising from about 10% to 90% by weight of the composition. More preferably, the surfactant mixture will comprise from about 15% to 50% by weight of the composition.

A typical listing of anionic, nonionic, ampholytic and zwitterionic classes, and species of these surfactants, is given in U.S. Pat. No. 3,664,961 issued to Norris on May 23, 1972.

Highly preferred anionic surfactants are the linear alkyl benzene sulfonate (LAS) materials. Such surfactants and their preparation are described for example in U.S. Pat. Nos. 2,220,099 and 2,477,383, incorporated herein by reference. Especially preferred are the sodium and potassium linear straight chain alkylbenzene sulfonates in which the average number of carbon atoms in the alkyl group is from about 11 to 14. Sodium $C_{11}$–$C_{14}$, e.g., $C_{12}$, LAS is especially preferred.

Other suitable anionic surfactants include the alkyl sulfate surfactants hereof are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{18}$ alkyl component, more preferably a $C_{12}$–$C_{15}$ alkyl or hydroxyalkyl, and M is H or a cation, e.g., an alkali metal cation (e.g. sodium, potassium, lithium), or ammonium or substituted ammonium (quaternary ammonium cations such as tetramethyl-ammonium and dimethyl piperdinium cations).

Other suitable anionic surfactants include alkyl alkoxylated sulfate surfactants hereof are water soluble salts or acids of the formula $RO(A)_mSO3M$ wherein R is an unsubstituted $C_{10}$–$C_{24}$ alkyl or hydroxyalkyl group having a $C_{10}$–$C_{24}$ alkyl component, preferably a $C_{12}$–$C_{18}$ alkyl or hydroxyalkyl, more preferably $C_{12}$–$C_{15}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include quaternary ammonium cations such as tetramethyl-ammonium and dimethyl piperdinium cations Exemplary surfactants are $C_{12}$–$C_{15}$ alkyl polyethoxylate (1.0) sulfate ($C_{12}$–$C_{15}$E(1.0)M), $C_{12}$–$C_{15}$ alkyl polyethoxylate (2.25) sulfate ($C_{12}$–$C_{15}$E(2.25)M), $C_{12}$–$C_{15}$ alkyl polyethoxylate (3.0) sulfate ($C_{12}$–$C_{15}$E(3.0)M), and $C_{12}$–$C_{15}$ alkyl polyethoxylate (4.0) sulfate ($C_{12}$–$C_{15}$E(4.0)M), wherein M is conveniently selected from sodium and potassium.

Other suitable anionic surfactants to be used are alkyl ester sulfonate surfactants including linear esters of $C_8$–$C_{20}$ carboxylic acids (i.e., fatty acids) which are sulfonated with gaseous $SO_3$ according to "The Journal of the American Oil Chemists Society", 52 (1975), pp. 323–329. Suitable starting materials would include natural fatty substances as derived from tallow, palm oil, etc.

The preferred alkyl ester sulfonate surfactant, especially for laundry applications, comprise alkyl ester sulfonate surfactants of the structural formula:

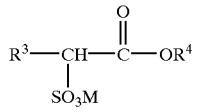

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations. Preferably, $R^3$ is $C_{10}$–$C_{16}$ alkyl, and $R^4$ is methyl, ethyl or isopropyl. Especially preferred are the methyl ester sulfonates wherein $R^3$ is $C_{10}$–$C_{16}$ alkyl.

Other anionic surfactants useful for detersive purposes can also be included in the laundry detergent compositions of the present invention. These can include salts (including, for example, sodium, potassium, ammonium, and substituted ammonium salts such as mono-, di- and triethanolamine salts) of soap, $C_8$–$C_{22}$ primary or secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl glycerol sulfonates, fatty acyl glycerol sulfonates, fatty oleyl glycerol sulfates, alkyl phenol ethylene oxide ether sulfates, paraffin. sulfonates, alkyl phosphates, isethionates such as the acyl isethionates, N-acyl taurates, alkyl succinamates and sulfosuccinates, monoesters of sulfosuccinates (especially saturated and unsaturated $C_{12}$–$C_{18}$ monoesters) and diesters of sulfosuccinates (especially saturated and unsaturated $C_6$–$C_{12}$ diesters), sulfates of alkylpolysaccharides such as the sulfates of alkylpolyglucoside (the nonionic nonsulfated compounds being described below), and alkyl polyethoxy carboxylates such as those of the formula $RO(CH_2CH_2O)_k$—$CH_2COO$—M+ wherein R is a $C_8$–$C_{22}$ alkyl, k is an integer from 1 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are described in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

When included therein, the detergent compositions of the present invention typically comprise from about 1% to about 40%, preferably from about 5% to about 25% by weight of such anionic surfactants.

Nonaqueous Liquid Diluent

To form the liquid phase of the detergent compositions, the hereinbefore described surfactant (mixture) may be combined with a nonaqueous, low-polarity organic solvent.

Nonaqueous Low-Polarity Organic Solvent

Another component of the liquid diluent which may form part of the detergent compositions herein comprises nonaqueous, low-polarity organic solvent(s). The term "solvent" is used herein to connote the non-surface active carrier or diluent portion of the liquid phase of the composition. While some of the essential and/or optional components of the compositions herein may actually dissolve in the "solvent"-containing phase, other components will be present as particulate material dispersed within the "solvent"-containing phase. Thus the term "solvent" is not meant to require that the solvent material be capable of actually dissolving all of the detergent composition components added thereto.

The nonaqueous organic materials which are employed as solvents herein are those which are liquids of low polarity. For purposes of this invention, "low-polarity" liquids are those which have little, if any, tendency to dissolve one of the preferred types of particulate material used in the compositions herein, i.e., the peroxygen bleaching agents, sodium perborate or sodium percarbonate. Thus relatively polar solvents such as ethanol should not be utilized. Suitable types of low-polarity solvents useful in the nonaqueous liquid detergent compositions herein do include alkylene glycol mono lower alkyl ethers, lower molecular weight polyethylene glycols, lower molecular weight methyl esters and amides, and the like.

A preferred type of nonaqueous, low-polarity solvent for use herein comprises the mono-, di-, tri-, or tetra-$C_2$–$C_3$ alkylene glycol mono $C_2$–$C_6$ alkyl ethers. The specific examples of such compounds include diethylene glycol monobutyl ether, tetraethylene glycol monobutyl ether, dipropolyene glycol monoethyl ether, and dipropylene glycol monobutyl ether. Diethylene glycol monobutyl ether and dipropylene glycol monobutyl ether are especially preferred. Compounds of the type have been commercially marketed under the tradenames Dowanol, Carbitol, and Cellosolve.

Another preferred type of nonaqueous, low-polarity organic solvent useful herein comprises the lower molecular weight polyethylene glycols (PEGs). Such materials are those having molecular weights of at least about 150. PEGs of molecular weight ranging from about 200 to 600 are most preferred.

Yet another preferred type of non-polar, nonaqueous solvent comprises lower molecular weight methyl esters. Such materials are those of the general formula: $R^1$—C(O)—$OCH_3$ wherein $R^1$ ranges from 1 to about 18. Examples of suitable lower molecular weight methyl esters include methyl acetate, methyl propionate, methyl octanoate, and methyl dodecanoate.

The nonaqueous, low-polarity organic solvent(s) employed should, of course, be compatible and non-reactive with other composition components, e.g., bleach and/or activators, used in the liquid detergent compositions herein. Such a solvent component will generally be utilized in an amount of from about 1% to 60% by weight of the composition. More preferably, the nonaqueous, low-polarity organic solvent will comprise from about 5% to 40% by weight of the composition, most preferably from about 10% to 25% by weight of the composition.

Liquid Diluent Concentration

As with the concentration of the surfactant mixture, the amount of total liquid diluent in the compositions herein will be determined by the type and amounts of other composition components and by the desired composition properties. Generally, the liquid diluent will comprise from about 20% to 80% by weight of the compositions herein. More preferably, the liquid diluent will comprise from about 40% to 60% by weight of the composition.

Solid Phase

The nonaqueous detergent compositions herein may further comprise a solid phase of particulate material which is dispersed and suspended within the liquid phase. Generally such particulate material will range in size from about 0.1 to 1500 microns. More preferably such material will range in size from about 5 to 200 microns.

The particulate material utilized herein can comprise one or more types of detergent composition components which in particulate form are substantially insoluble in the nonaqueous liquid phase of the composition. The types of particulate materials which can be utilized are described in detail as follows:

Surfactants

A type of particulate material which can be suspended in the nonaqueous liquid detergent compositions herein includes ancillary anionic surfactants which are fully or partially insoluble in the nonaqueous liquid phase. The most common type of anionic surfactant with such solubility properties comprises primary or secondary alkyl sulfate anionic surfactants. Such surfactants are those produced by the sulfation of higher $C_8$–$C_{20}$ fatty alcohols.

Conventional primary alkyl sulfate surfactants have the general formula $$ROSO_3^-M^+$$

wherein R is typically a linear $C_8$–$C_{20}$ hydrocarbyl group, which may be straight chain or branched chain, and M is a water-solubilizing cation. Preferably R is a $C_{10}$–$C_{14}$ alkyl, and M is alkali metal. Most preferably R is about $C_{12}$ and M is sodium.

Conventional secondary alkyl sulfates may also be utilized as the essential anionic surfactant component of the solid phase of the compositions herein. Conventional secondary alkyl sulfate surfactants are those materials which have the sulfate moiety distributed randomly along the hydrocarbyl "backbone" of the molecule. Such materials may be depicted by the structure $$CH_3(CH_2)_n(CHOSO_3^-M^+)(CH_2)_mCH_3$$

wherein m and n are integers of 2 or greater and the sum of m+n is typically about 9 to 15, and M is a water-solubilizing cation.

If utilized as all or part of the requisite particulate material, ancillary anionic surfactants such as alkyl sulfates will generally comprise from about 1% to 10% by weight of the composition, more preferably from about 1% to 5% by weight of the composition. Alkyl sulfate used as all or part of the particulate material is prepared and added to the compositions herein separately from the unalkoxylated alkyl sulfate material which may form part of the alkyl ether sulfate surfactant component essentially utilized as part of the liquid phase herein.

Organic Builder Material

Another possible type of particulate material which can be suspended in the nonaqueous liquid detergent compositions herein comprises an organic detergent builder material which serves to counteract the effects of calcium, or other ion, water hardness encountered during laundering/bleaching use of the compositions herein. Examples of such materials include the alkali metal, citrates, succinates, malonates, fatty acids, carboxymethyl succinates, carboxylates, polycarboxylates and polyacetyl carboxylates. Specific examples include sodium, potassium and lithium salts of oxydisuccinic acid, mellitic acid, benzene polycarboxylic acids and citric acid. Other examples of organic phosphonate type sequestering agents such as those which have been sold by Monsanto under the Dequest tradename and alkanehydroxy phosphonates. Citrate salts are highly preferred.

Other suitable organic builders include the higher molecular weight polymers and copolymers known to have builder properties. For example, such materials include appropriate polyacrylic acid, polymaleic acid, and polyacrylic/polymaleic acid copolymers and their salts, such as those sold by BASF under the Sokalan trademark.

Another suitable type of organic builder comprises the water-soluble salts of higher fatty acids, i.e., "soaps". These include alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

If utilized as all or part of the requisite particulate material, insoluble organic detergent builders can generally comprise from about 2% to 20% by weight of the compositions herein. More preferably, such builder material can comprise from about 4% to 10% by weight of the composition.

Inorganic Alkalinity Sources

Another possible type of particulate material which can be suspended in the nonaqueous liquid detergent compositions herein can comprise a material which serves to render aqueous washing solutions formed from such compositions generally alkaline in nature. Such materials may or may not also act as detergent builders, i.e., as materials which counteract the adverse effect of water hardness on detergency performance.

Examples of suitable alkalinity sources include water-soluble alkali metal carbonates, bicarbonates, borates, silicates and metasilicates. Although not preferred for ecological reasons, water-soluble phosphate salts may also be utilized as alkalinity sources. These include alkali metal pyrophosphates, orthophosphates, polyphosphates and phosphonates. Of all of these alkalinity sources, alkali metal carbonates such as sodium carbonate are the most preferred.

The alkalinity source, if in the form of a hydratable salt, may also serve as a desiccant in the nonaqueous liquid detergent compositions herein. The presence of an alkalinity source which is also a desiccant may provide benefits in terms of chemically stabilizing those composition components such as the peroxygen bleaching agent which may be susceptible to deactivation by water.

If utilized as all or part of the particulate material component, the alkalinity source will generally comprise from about 1% to 15% by weight of the compositions herein. More preferably, the alkalinity source can comprise from about 2% to 10% by weight of the composition. Such materials, while water-soluble, will generally be insoluble in the nonaqueous detergent compositions herein. Thus such materials will generally be dispersed in the nonaqueous liquid phase in the form of discrete particles.

Optional Composition Components

In addition to the composition liquid and solid phase components as hereinbefore described, the detergent compositions herein can, and preferably will, contain various optional components. Such optional components may be in either liquid or solid form. The optional components may either dissolve in the liquid phase or may be dispersed within the liquid phase in the form of fine particles or droplets. Some of the materials which may optionally be utilized in the compositions herein are described in greater detail as follows:

Optional Inorganic Detergent Builders

The detergent compositions herein may also optionally contain one or more types of inorganic detergent builders beyond those listed hereinbefore that also function as alkalinity sources. Such optional inorganic builders can include, for example, aluminosilicates such as zeolites. Aluminosilicate zeolites, and their use as detergent builders are more fully discussed in Corkill et al., U.S. Pat. No. 4,605,509; Issued Aug. 12, 1986, the disclosure of which is incorporated herein by reference. Also crystalline layered silicates, such as those discussed in this '509 U.S. patent, are also suitable for use in the detergent compositions herein. If utilized, optional inorganic detergent builders can comprise from about 2% to 15% by weight of the compositions herein.

Optional Enzymes

The detergent compositions herein may also optionally contain one or more types of detergent enzymes. Such enzymes can include proteases, amylases, cellulases and lipases. Such materials are known in the art and are commercially available. They may be incorporated into the nonaqueous liquid detergent compositions herein in the form of suspensions, "marumes" or "prills". Another suitable type of enzyme comprises those in the form of slurries of enzymes in nonionic surfactants. Enzymes in this form have been commercially marketed, for example, by Novo Nordisk under the tradename "LDP."

Enzymes added to the compositions herein in the form of conventional enzyme prills are especially preferred for use herein. Such prills will generally range in size from about 100 to 1,000 microns, more preferably from about 200 to 800 microns and will be suspended throughout the nonaqueous liquid phase of the composition. Prills in the compositions of the present invention have been found, in comparison with other enzyme forms, to exhibit especially desirable enzyme stability in terms of retention of enzymatic activity over time. Thus, compositions which utilize enzyme prills need not contain conventional enzyme stabilizing such as must frequently be used when enzymes are incorporated into aqueous liquid detergents.

If employed, enzymes will normally be incorporated into the nonaqueous liquid compositions herein at levels sufficient to provide up to about 10 mg by weight, more typically from about 0.01 mg to about 5 mg, of active enzyme per gram of the composition. Stated otherwise, the nonaqueous liquid detergent compositions herein will typically comprise from about 0.001% to 5%, preferably from about 0.01% to 1% by weight, of a commercial enzyme preparation. Protease enzymes, for example, are usually present in such commercial preparations at levels sufficient to provide from 0.005 to 0.1 Anson units (AU) of activity per gram of composition.

Optional Chelating Agents

The detergent compositions herein may also optionally contain a chelating agent which serves to chelate metal ions, e.g., iron and/or manganese, within the nonaqueous detergent compositions herein. Such chelating agents thus serve to form complexes with metal impurities in the composition which would otherwise tend to deactivate composition components such as the peroxygen bleaching agent. Useful chelating agents can include amino carboxylates, phosphonates, amino phosphonates, polyfunctionally-substituted aromatic chelating agents and mixtures thereof.

Amino carboxylates useful as optional chelating agents include ethylenediaminetetraacetates, N-hydroxyethylethylene-diaminetriacetates, nitrilotriacetates, ethylene-diamine tetrapropionates, triethylenetetraaminehexacetates, diethylenetriaminepentaacetates, ethylenediaminedisuccinates and ethanoldiglycines. The alkali metal salts of these materials are preferred.

Amino phosphonates are also suitable for use as chelating agents in the compositions of this invention when at least low levels of total phosphorus are permitted in detergent compositions, and include ethylenediaminetetrakis (methylene-phosphonates) as DEQUEST. Preferably, these amino phosphonates do not contain alkyl or alkenyl groups with more than about 6 carbon atoms.

Preferred chelating agents include hydroxyethyldiphosphonic acid (HEDP), diethylene triamine penta acetic acid (DTPA), ethylenediamine disuccinic acid (EDDS) and dipicolinic acid (DPA) and salts thereof. The chelating agent may, of course, also act as a detergent builder during use of the compositions herein for fabric laundering/bleaching. The chelating agent, if employed, can comprise from about 0.1% to 4% by weight of the compositions herein. More preferably, the chelating agent will comprise from about 0.2% to 2% by weight of the detergent compositions herein.

Optional Thickening, Viscosity Control and/or Dispersing Agents

The detergent compositions herein may also optionally contain a polymeric material which serves to enhance the ability of the composition to maintain its solid particulate components in suspension. Such materials may thus act as thickeners, viscosity control agents and/or dispersing agents. Such materials are frequently polymeric polycarboxylates but can include other polymeric materials such as polyvinylpyrrolidone (PVP) and polymeric amine derivatives such as quaternized, ethoxylated hexamethylene diamines.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than about 40% by weight of the polymer.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000, and most preferably from about 4,000 to 5,000. Water-soluble salts of such acrylic acid polymers can include, for example, the alkali metal, salts. Soluble polymers of this type are known materials. Use of polyacrylates of this type in detergent compositions has been disclosed, for example, Diehl, U.S. Pat. No. 3,308,067, issued Mar. 7, 1967. Such materials may also perform a builder function.

If utilized, the optional thickening, viscosity control and/or dispersing agents should be present in the compositions herein to the extent of from about 0.1% to 4% by weight. More preferably, such materials can comprise from about 0.5% to 2% by weight of the detergents compositions herein.

Optional Brighteners, Suds Suppressors and/or Perfumes

The detergent compositions herein may also optionally contain conventional brighteners, suds suppressors, silicone oils, bleach catalysts, and/or perfume materials. Such brighteners, suds suppressors, silicone oils, bleach catalysts, and perfumes must, of course, be compatible and non-reactive with the other composition components in a nonaqueous environment. If present, brighteners suds suppressors and/or perfumes will typically comprise from about 0.01% to 2% by weight of the compositions herein.

Suitable bleach catalysts include the manganese based complexes disclosed in U.S. Pat. No. 5,246,621, U.S. Pat. No. 5,244,594, U.S. Pat. No. 5,114,606 and U.S. Pat. No. 5,114,611.

Composition Form

The particulate-containing liquid detergent compositions of this invention are substantially nonaqueous (or anhydrous) in character. While small amounts of water may be incorporated into such compositions as an impurity in the essential or optional components, the amount of water should in no event exceed about 5% by weight of the compositions herein. More preferably, water content of the nonaqueous detergent compositions herein will comprise less than about 1% by weight.

The particulate-containing nonaqueous detergent compositions herein will be in the form of a liquid.

Composition Preparation and Use

The non-aqueous liquid detergent compositions herein can be prepared by first forming the surfactant-containing non-aqueous liquid phase and by thereafter adding to this phase the additional particulate components in any convenient order and by mixing, e.g., agitating, the resulting component combination to form the phase stable compositions herein. In a typical process for preparing such compositions, essential and certain preferred optional components will be combined in a particular order and under certain conditions.

In a first step of a preferred preparation process, the anionic surfactant-containing powder used to form the surfactant-containing liquid phase is prepared. This prepreparation step involves the formation of an aqueous slurry containing from 40% to 50% of one or more alkali metal salts of linear $C_{10-16}$ alkyl benzene sulfonic acid and from 3% to 15% of one or more diluent non-surfactant salts. In a subsequent step, this slurry is dried to the extent necessary to form a solid material containing less than 5% by weight of residual water.

After preparation of this solid anionic surfactant-containing material, this material can be combined with one or more of the non-aqueous organic solvents to form the surfactant-containing liquid phase of the detergent compositions herein. This is done by reducing the anionic surfactant-containing material formed in the previously described pre-preparation step to powdered form and by combining such powdered material with an agitated liquid medium comprising one or more of the non-aqueous organic solvents, either surfactant or non-surfactant or both, as hereinbefore described. This combination is carried out under agitation conditions which are sufficient to form a thoroughly mixed dispersion of the LAS-salt material throughout a non-aqueous organic liquid.

In a subsequent processing step, the non-aqueous liquid dispersion so prepared can then be subjected to milling or high shear agitation under conditions which are sufficient to provide the structured, surfactant-containing liquid phase of the detergent compositions herein. Such milling or high shear agitation conditions will generally include maintenance of a temperature between 20° C. and 50° C. Milling and high shear agitation of this combination will generally provide an increase in the yield value of the structured liquid phase to within the range of from 1 Pa to 5 Pa.

After formation of the dispersion of LAS-salt co-dried material in the non-aqueous liquid, either before or after such dispersion is milled or agitated to increase its yield value, the additional particulate material to be used in the detergent compositions herein can be added. Such components which can be added under high shear agitation include any optional surfactant particles, particles of substantially all of an organic builder, e.g., citrate and/or fatty acid, and/or an alkalinity source, e.g., sodium carbonate, can be added while continuing to maintain this admixture of composition components under shear agitation. Agitation of the mixture is continued, and if necessary, can be increased at this point to form a uniform dispersion of insoluble solid phase particulates within the liquid phase.

In a second process step, the bleach precursor particles are mixed with the ground suspension from the first mixing step in a second mixing step. This mixture is then subjected to wet grinding so that the average particle size of the bleach precursor is less than 600 microns, preferably between 50 and 500 microns, most preferred between 100 and 400 microns. Other compounds, such as bleach compounds are then added to the resulting mixture.

After some or all of the foregoing solid materials have been added to this agitated mixture, the particles of the highly preferred peroxygen bleaching agent can be added to the composition, again while the mixture is maintained under shear agitation. By adding the peroxygen bleaching agent material last, or after all or most of the other components have been added, desirable stability benefits for the peroxygen bleach can be realized. If enzyme prills are incorporated, they are preferably added to the non-aqueous liquid matrix last.

As a final process step, after addition of all of the particulate material, agitation of the mixture is continued for a period of time sufficient to form compositions having the requisite viscosity, yield value and phase stability characteristics. Frequently this will involve agitation for a period of from about 1 to 30 minutes.

In adding solid components to non-aqueous liquids in accordance with the foregoing procedure, it is advantageous to maintain the free, unbound moisture content of these solid materials below certain limits. Moisture in such solid materials is frequently present at levels of 0.8% or greater. By reducing moisture content, e.g., by fluid bed drying, of solid particulate materials to a free moisture level of 0.5% or lower prior to their incorporation into the detergent composition matrix, significant stability advantages for the resulting composition can be realized.

The compositions of this invention, prepared as hereinbefore described, can be used to form aqueous washing solutions for use in the laundering and bleaching of fabrics. Generally, an effective amount of such compositions is added to water, preferably in a conventional fabric laundering automatic washing machine, to form such aqueous laundering/bleaching solutions. The aqueous washing/bleaching solution so formed is then contacted, preferably under agitation, with the fabrics to be laundered and bleached therewith.

An effective amount of the liquid detergent compositions herein added to water to form aqueous laundering/bleaching solutions can comprise amounts sufficient to form from about 500 to 7,000 ppm of composition in aqueous solution. More preferably, from about 800 to 5,000 ppm of the detergent compositions herein will be provided in aqueous washing/bleaching solution.

The following examples illustrate the preparation and performance advantages of non-aqueous liquid detergent compositions of the instant invention. Such examples, however, are not necessarily meant to limit or otherwise define the scope of the invention herein.

EXAMPLE I

Preparation of Non-Aqueous Liquid Detergent Composition

1) Butoxy-propoxy-propanol (BPP) and a $C_{12-6}$EO(5) ethoxylated alcohol nonionic surfactant (Genapol 24/50) are mixed for a short time (1–5 minutes) using a blade impeller in a mix tank into a single phase.
2) NaLAS is added to the BPP/Genapol solution in the mix tank to partially dissolve the NaLAS. Mix time is approximately one hour. The tank is blanketed with nitrogen to prevent moisture pickup from the air.

3) If needed, liquid base (LAS/BPP/NI) is pumped out into drums. Molecular sieves (type 3A, 4–8 mesh) are added to each drum at 10% of the net weight of the liquid base. The molecular sieves are mixed into the liquid base using both single blade turbine mixers and drum rolling techniques. The mixing is done under nitrogen blanket to prevent moisture pickup from the air. Total mix time is 2 hours, after which 0.1–0.4% of the moisture in the liquid base is removed. Molecular sieves are removed by passing the liquid base through a 20–30 mesh screen. Liquid base is returned to the mix tank.
4) Additional solid ingredients are prepared for addition to the composition. Such solid ingredients include the following:

Sodium carbonate (particle size 100 microns)

Sodium citrate anhydrous

Maleic-acrylic copolymer (BASF Sokolan)

Brightener (Tinopal PLC)

Tetra sodium salt of hydroxyethylidene diphosphonic acid (HEDP)

Sodium diethylene triamine penta methylene phosphonate

These solid materials, which are all millable, are added to the mix tank and mixed with the liquid base until smooth. This approximately 1 hour after addition of the last powder. The tank is blanketed with nitrogen after addition of the powders. No particular order of addition for these powders is critical.
6) The batch is pumped once through a Fryma colloid mill, which is a simple rotor-stator configuration in which a high-speed rotor spins inside a stator which creates a zone of high shear. This partially reduces the particle size of all of the solids. This leads to an increase in yield value (i.e. structure). The batch is then recharged to the mix tank after cooling.
7) The bleach precursor particles are mixed with the ground suspension from the first mixing step in a second mixing step. This mixture is then subjected to wet grinding so that the average particle size of the bleach precursor is less than 600 microns, preferably between 50 and 500 microns, most preferred between 100 and 400 microns.
8) Other solid materials could be added after the first step. These include the following:

Sodium percarbonate (400–600 microns)

Protease, cellulase and amylase enzyme prills (400–800 microns)

Titanium dioxide particles (5 microns)

These non-millable solid materials are then added to the mix tank followed by liquid ingredients (perfume and silicone-based suds suppressor). The batch is then mixed for one hour (under nitrogen blanket). The resulting composition has the formula set forth in Table I.

TABLE I

| Non-Aqueous Liquid Detergent Composition with Bleach | |
|---|---|
| Component | Wt % Active |
| LAS Na Salt | 21.7 |
| C12–16 EO = 5 alcohol ethoxylate | 18.98 |
| BPP | 18.98 |
| Sodium citrate | 1.42 |
| [4-[N-nonanoyl-6-aminohexanoyloxy] benzene sulfonate] Na salt | 7.34 |
| DiEthyleneTriamine PentaMethylenePhosphate Na salt | 0.90 |
| Chloride salt of methyl quaternized | 0.95 |

TABLE I-continued

| Non-Aqueous Liquid Detergent Composition with Bleach | |
|---|---|
| Component | Wt % Active |
| polyethoxylated hexamethylene diamine | |
| Sodium Carbonate | 3 |
| Maleic-acrylic copolymer | 3.32 |
| HEDP-Na salt | 0.90 |
| Protease Prills | 0.40 |
| Amylase Prills | 0.84 |
| Sodium Percarbonate | 18.89 |
| Suds Suppressor | 0.35 |
| Perfume | 0.46 |
| Titanium Dioxide | 0.5 |
| Brightener | 0.14 |
| Miscellaneous up to | 100.00% |

The resulting Table I composition is a stable, anhydrous heavy-duty liquid laundry detergent which provides excellent stain and soil removal performance when used in normal fabric laundering operations.

A bleach-containing nonaqueous laundry detergent is prepared having the composition as set forth in Table II.

TABLE II

| | Example 1 | Example 2 |
|---|---|---|
| Component | Wt. % | |
| Liquid Base | | |
| Sodium Linear alkyl benzene sulfonate | 20 | 20 |
| $C_{12-14}$, EO = 5 alcohol ethoxylate | 20 | 20 |
| N-Butoxy propoxy propanol (BPP) | 20 | 20 |
| Perfume | 1 | 1 |
| Solids | | |
| Trisodium Citrate | 1.5 | 1.5 |
| Sodium percarbonate | 20 | 15 |
| Sodium carbonate | 5 | 10 |
| DiEthylene Triamine Penta Metylene-Phosphate Na salt | 1 | — 1 |
| Hydroxyethyl diphosphonate (HEDP) Na salt | 1.5 | 1.5 |
| [4-[N-nonanoyl-6-aminohexanoyloxy] benzene sulfonate] Na salt average particle size <500 microns | 5 | 5 |
| Brightener | 0.2 | 0.2 |
| TiO2 | 0.5 | 0.5 |
| Enzymes and minors | up to 100% | |

The above compositions are stable anhydrous liquid laundry detergents wherein the bleach activator is stable in the concentrate and wherein the bleach activator is effective in the wash liquor.

What is claimed is:

1. A liquid nonaqueous detergent composition comprising an alcohol alkoxylate nonionic surfactant and a bleach precursor having a Krafft point of at least 10° C., said nonionic surfactant and the bleach precursor being present in a molar ratio of nonionic surfactant to bleach precursor of at least 2:1, and wherein the amount of water present in the composition does not exceed 5% by weight of the composition.

2. A liquid nonaqueous detergent composition according to claim 1, wherein said surfactant is selected from polyethylene, polypropylene, and polybutylene oxide condensates of alkyl phenols, condensation products of aliphatic alcohols with from 1 to 25 moles of ethylene oxide, condensation products of ethylene oxide with a hydrophobic base formed by the condensation of propylene oxide with propylene glycol, condensation products of ethylene oxide with the product resulting from the reaction of propylene oxide and ethylenediamine, and mixtures thereof.

3. A liquid nonaqueous detergent composition according to claim 1, wherein said bleach precursor has a Krafft point of at least 50° C.

4. A liquid nonaqueous detergent composition according to claim 1, wherein said bleach precursor is selected from anionic bleach precursors.

5. A liquid nonaqueous detergent composition according to claim 4, wherein said bleach precursor is an anionic bleach precursor of the amido peroxy class.

6. A liquid nonaqueous detergent composition according to claim 5, wherein said bleach precursor is selected from monovalent, divalent, and trivalent metal salts of amide substituted peroxyacid precursor compounds, and mixtures thereof.

7. A liquid nonaqueous detergent composition according to claim 6, wherein said bleach precursor is selected from (6-octanamido-caproyl)oxybenzenesulfonate, (6-nonanamido-caproyl)oxybenzenesulfonate, (6-decanamido-caproyl)oxybenzenesulfonate, and mixtures thereof.

8. A liquid nonaqueous detergent composition according to claim 1, further comprising a bleach co-precursor selected from acetyl triethyl citrate and nonanoyloxybenzene sulfonate.

9. A liquid nonaqueous detergent composition according to claim 1 further comprising a peroxygen bleaching agent.

10. A liquid nonaqueous detergent composition according to claim 3, wherein said bleach precursor has a Krafft point of at least 60°.

11. A liquid nonaqueous detergent composition according to claim 6, wherein said bleach precursor comprises a monovalent salt of an amide substituted peroxyacid precursor compound.

12. A liquid nonaqueous detergent composition according to claim 1, comprising from 5% to 50% by weight of the composition of the alcohol alkoxylate nonionic surfactant.

13. A liquid nonaqueous detergent composition according to claim 1, comprising from 10% to 30% by weight of the composition of the alcohol alkoxylate nonionic surfactant.

14. A liquid nonaqueous detergent composition according to claim 1, comprising from 15% to 25% by weight of the composition of the alcohol alkoxylate nonionic surfactant.

15. A liquid nonaqueous detergent composition according to claim 12, comprising from 0.1% to 25% by weight of the composition of the bleach precursor.

16. A liquid nonaqueous detergent composition according to claim 12, comprising from 1% to 20% by weight of the composition of the bleach precursor.

17. A liquid nonaqueous detergent composition according to claim 12, comprising from 3% to 15% by weight of the composition of the bleach precursor.

18. A liquid nonaqueous detergent composition according to claim 1, further comprising from about 1% to about 40% by weight of the composition of anionic surfactant.

19. A liquid nonaqueous detergent composition according to claim 1, further comprising from about 5% to about 25% by weight of the composition of anionic surfactant.

20. A liquid nonaqueous detergent composition according to claim 19, wherein the anionic surfactant comprises linear alkyl benzene sulfonate.

21. A liquid nonaqueous detergent composition according to claim 1, wherein the nonionic surfactant and the bleach precursor are present in a molar ratio of nonionic surfactant to bleach precursor of at least 4:1.

22. A liquid nonaqueous detergent composition according to claim 1, wherein the amount of water present in the composition is less than 1% by weight of the composition.

23. A liquid nonaqueous detergent composition comprising an alcohol alkoxylate nonionic surfactant and an anionic bleach precursor of the amido peroxy class and selected from the group consisting of monovalent, divalent, and trivalent metal salts of amide substituted peroxyacid precursor compounds, and mixtures thereof, wherein the nonionic surfactant and the anionic bleach precursor are present in a molar ratio of nonionic surfactant to anionic bleach precursor of at least 2:1, and wherein the amount of water present in the composition does not exceed 5% by weight of the composition.

24. A liquid nonaqueous detergent composition according to claim 23, wherein the nonionic surfactant and the anionic bleach precursor surfactant are present in a molar ratio of nonionic surfactant to anionic bleach precursor of at least 4:1.

25. A liquid nonaqueous detergent composition according to claim 23, wherein the amount of water present in the composition is less than 1% by weight of the composition.

* * * * *